US011342142B2

(12) United States Patent
Baron et al.

(10) Patent No.: US 11,342,142 B2
(45) Date of Patent: May 24, 2022

(54) SHIELD ELEMENT FOR A VACUUM INTERRUPTER

(71) Applicant: SIEMENS AKTIENGESELLSCHAFT, Munich (DE)

(72) Inventors: Lydia Baron, Dallgow-Doeberitz (DE); Frank Graskowski, Wandlitz (DE); Christian Stiehler, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/771,804

(22) PCT Filed: Nov. 20, 2018

(86) PCT No.: PCT/EP2018/081926
§ 371 (c)(1),
(2) Date: Jun. 11, 2020

(87) PCT Pub. No.: WO2019/115177
PCT Pub. Date: Jun. 20, 2019

(65) Prior Publication Data

US 2021/0074495 A1 Mar. 11, 2021

(30) Foreign Application Priority Data

Dec. 11, 2017 (DE) ..... 102017222415

(51) Int. Cl.
*H01H 33/662* (2006.01)
*H01H 33/666* (2006.01)

(52) U.S. Cl.
CPC .... *H01H 33/66261* (2013.01); *H01H 33/666* (2013.01)

(58) Field of Classification Search
CPC ..... H01H 33/66261; H01H 33/66207; H01H 33/666; H01H 2033/66276;
(Continued)

(56) References Cited

U.S. PATENT DOCUMENTS 3,903,386 A * 9/1975 Yanagisawa ..... H01H 33/66261 218/136
4,081,640 A * 3/1978 Rich ..... H01H 33/664 218/123
(Continued)

FOREIGN PATENT DOCUMENTS

CN 102047366 A 5/2011
CN 102292788 A 12/2011
(Continued)

*Primary Examiner* — William A Bolton
(74) *Attorney, Agent, or Firm* — Laurence A. Greenberg; Werner H. Stemer; Ralph E. Locher

(57) ABSTRACT

A shield element for a vacuum interrupter for installation between an electrically conductive wall element and an electrically insulating wall element of a vacuum interrupter includes a connection region, a shield inner region and a shield outer region. The shield outer region can be disposed outside of and the shield inner region can be disposed within the vacuum interrupter. The connection region has a first structure and a second structure which prevent the formation of mechanical stresses after soldering of the vacuum interrupter. A vacuum interrupter, a method for producing a shield element and a method for producing a vacuum interrupter are also provided.

12 Claims, 2 Drawing Sheets

(58) Field of Classification Search
CPC ..... H01H 2033/66215; H01H 2033/66223; H01H 2033/6623
USPC ..... 218/123, 136, 134, 137, 139, 118, 147
See application file for complete search history.

(56) References Cited

U.S. PATENT DOCUMENTS

| | | | | |
|---|---|---|---|---|
| 5,222,651 | A * | 6/1993 | Pilsinger | H01H 11/00 228/122.1 |
| 6,308,857 | B1 | 10/2001 | Heimbach et al. | |
| 6,891,122 | B2 * | 5/2005 | Renz | H01H 33/66261 218/11 |
| 7,205,499 | B2 * | 4/2007 | Masnada | H01H 33/66261 218/134 |
| 8,039,771 | B2 * | 10/2011 | Trondsen | H01H 33/66261 218/136 |
| 2014/0251958 | A1 | 9/2014 | Wang et al. | |
| 2016/0045969 | A1 | 2/2016 | Graskowski et al. | |
| 2016/0184913 | A1 | 6/2016 | Gentsch | |
| 2017/0287659 | A1 | 10/2017 | Ryu | |

FOREIGN PATENT DOCUMENTS

| | | | |
|---|---|---|---|
| CN | 104145318 | A | 11/2014 |
| CN | 105683413 | A | 6/2016 |
| CN | 107275148 | A | 10/2017 |
| CN | 107342185 | A | 11/2017 |
| DE | 3628174 | A1 | 2/1988 |
| DE | 29717489 | U1 | 1/1999 |
| DE | 10007907 | A1 | 12/2000 |
| DE | 10220110 | A1 | 11/2003 |
| DE | 102013204775 | A1 | 9/2014 |
| EP | 1059650 | A2 | 12/2000 |
| EP | 1249850 | A2 | 10/2002 |
| EP | 3134912 | A1 | 3/2017 |
| WO | WO 2015193065 | A1 | 12/2015 |

* cited by examiner

SHIELD ELEMENT FOR A VACUUM INTERRUPTER

BACKGROUND OF THE INVENTION

Field of the Invention

The invention relates to a shield element for a vacuum interrupter, to a vacuum interrupter having such a shield element, to a method for producing such a shield element, and to a method for producing a vacuum interrupter having such a shield element.

Shield elements for vacuum interrupters are known from the prior art. They are used for field control, and prevent electrically insulating regions of the vacuum interrupter from being coated with deposited vaporized metal in the event of arcs. In connection with the closure soldering of a vacuum interrupter, induced mechanical stresses can occur, in particular during cooling after closure soldering in the vacuum furnace, which result in cracks in the vacuum interrupter, in particular in electrically insulating regions. Cracks in the vacuum interrupter can result in a breakdown of the vacuum in the vacuum interrupter, and thus in a loss of switching capability.

SUMMARY OF THE INVENTION

The object of the invention is to provide a shield element that eliminates the disadvantages of prior art and that, in particular, reduces the induced mechanical stresses in the vicinity of the closure soldering.

This object is achieved by the independent claims as described below, and by the claims dependent on them.

An exemplary embodiment relates to a shield element for a vacuum interrupter for arrangement between an electrically conductive wall element and an electrically insulating wall element of a vacuum interrupter, wherein the shield element has a connection region, a shield inner region and a shield outer region, wherein the shield outer region is designed for arrangement outside of, and the shield inner region is designed for arrangement within, the vacuum interrupter, the connection region has a first structure and a second structure that prevent the occurrence of mechanical stresses after the vacuum interrupter has been soldered.

In particular, it is preferred that the outer diameter of the shield element exceed 200 mm.

It is also preferred that the shield element can be used in vacuum interrupters for medium-voltage applications and/or high-voltage applications, in particular in vacuum interrupters for voltages over 140 kV, in particular voltages equal to or over 145 kV.

It is also preferred that the shield element have a shield inner region, a first structure, a second structure and a shield outer region, and that the shield element have a shape, in a radial section, in which the shield outer region runs linearly from an outer end to the second structure, in particular perpendicularly in relation to the course of a central axis of a vacuum interrupter, the second structure is U-shaped, the first structure is U-shaped, wherein the first structure and the second structure share a limb in such a manner that an opening of the first structure faces in the direction opposite to that of an opening of a second structure, another limb of the first structure, which is not the common limb of the first structure and the second structure, extending further and merging into the shield inner region.

The U-shaped structures in this case may have rounded or pointed corners, i.e. have the shape of a U or of a box open toward one side.

It is also preferred that the first structure and the second structure, when fitted in a vacuum interrupter, adjoin one another in such a manner that the first structure contacts an end face of the electrically insulating wall element with a limb that is also a limb of the second structure, without contacting an inner side of the electrically insulating wall element and/or the edge between the inner side and the end face, and that the second structure contact the end face of the electrically insulating wall element without contacting an outer side of the electrically insulating wall element and/or the edge between the outer side and the end face.

It is further preferred that the first structure and/or the second structure are each designed as a U-shaped bend having an opening, or U-shaped box having an opening.

In particular, it is further preferred that the first structure and the second structure be arranged in such a manner that the openings of the U-shaped bends or boxes face in opposite directions.

In particular, it is also preferred that the opening of the first structure be oriented, parallel to a central axis, toward the end face, and the opening of the second structure be oriented, parallel to a central axis, away from the end face (55).

It is also preferred, in particular, that the second U-shaped bend or U-shaped box have a width that is less than a wall thickness of the electrically insulating wall element.

A further exemplary embodiment relates to a vacuum interrupter having one or more shield elements according to one or more of the preceding embodiments.

One exemplary embodiment relates to a method for producing a shield element, wherein the shield element is produced from an initial metal sheet by forming, in such a manner that it has a shield inner region, a first structure, a second structure and a shield outer region, and that, following the forming process, the shield element has a shape, in a radial section, in which the shield outer region runs linearly from an outer end to the second structure, in particular perpendicularly in relation to the course of a central axis of a vacuum interrupter, the second structure is U-shaped, the first structure is U-shaped, wherein the first structure and the second structure share a limb in such a manner that an opening of the first structure faces in the direction opposite to that of an opening of a second structure, another limb of the first structure, which is not the common limb of the first structure and the second structure, extending further and merging into the bent shield inner region.

A further exemplary embodiment relates to a method for producing a vacuum interrupter, wherein components of the vacuum interrupter are treated at the joints with a solder material, wherein the components of the vacuum interrupter include, at least:

- a contact system,
- flanges,
- electrically insulating wall elements, having an end face,
- electrically conductive wall elements, and
- a shield element as claimed in any one of the above embodiments, or produced according to the above embodiment, wherein the end face of the electrically insulating wall element is provided with a metallization, and the metallization is treated with solder material, the components are stacked in such a manner that the components can be soldered, or are soldered, in one method step in a vacuum furnace, wherein the shield element is arranged between the electrically insulating wall element and the electrically conductive wall element in such a manner that a tapered region of the electrically conductive wall element is arranged in the opening of the second structure and rests on a base of the second structure, and the side of the second structure that is opposite the opening lies entirely on the solder-treated metallization of the end face, and during soldering, on the one hand, the solder material flows between the components to be connected and, on the other hand, however, during cooling, no mechanical stresses, or reduced mechanical stresses, are induced that cause components, in particular electrically insulating wall elements, to fracture.

The invention is explained, in the context of exemplary embodiments, on the basis of figures.

DETAILED DESCRIPTION OF THE INVENTION

Figure 1:
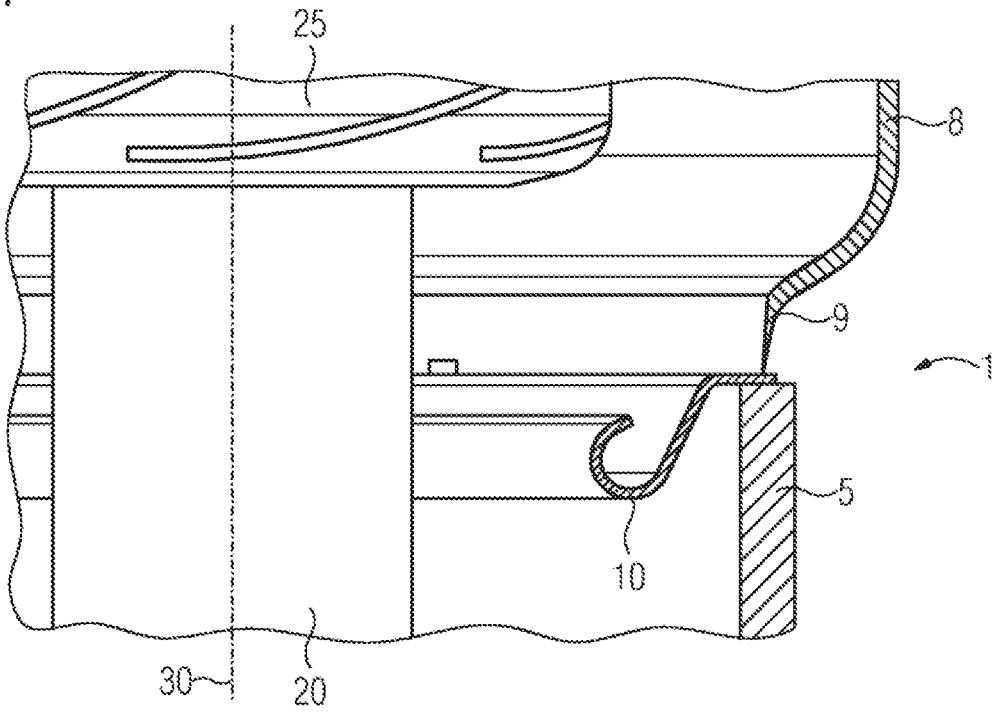
FIG. 1: schematic representation of a portion of a vacuum interrupter having a shield element from the prior art.

Shown schematically in FIG. 1 is a portion of a vacuum interrupter 1 having a shield element 10 from the prior art. A part of the shield element 10 lies on an end face, not denoted by a reference numeral, of an electrically insulating wall element 5. Lying on the part of the shield element 10, in turn, is a tapered region 9 of an electrically conductive wall element 8, the shield element 10, the electrically insulating wall element 5 and the tapered region of the electrically conductive wall element 8 being soldered together there. In the case of large external diameters of the shield element 10 and of the electrically insulating wall element 5, in particular over 200 mm, mechanical stresses are induced, in particular in the electrically insulating wall element 5, in the course of the closure soldering process. This occurs, in particular, because of the differing coefficients of thermal expansion of the electrically insulating wall element 5 and of the electrically conductive wall element 8. The figure shows, as further components of the vacuum interrupter, a contact rod 20 having a contact body 25, and a central axis 30 of the contact rod 20 and of the vacuum interrupter 1.

Figure 2:
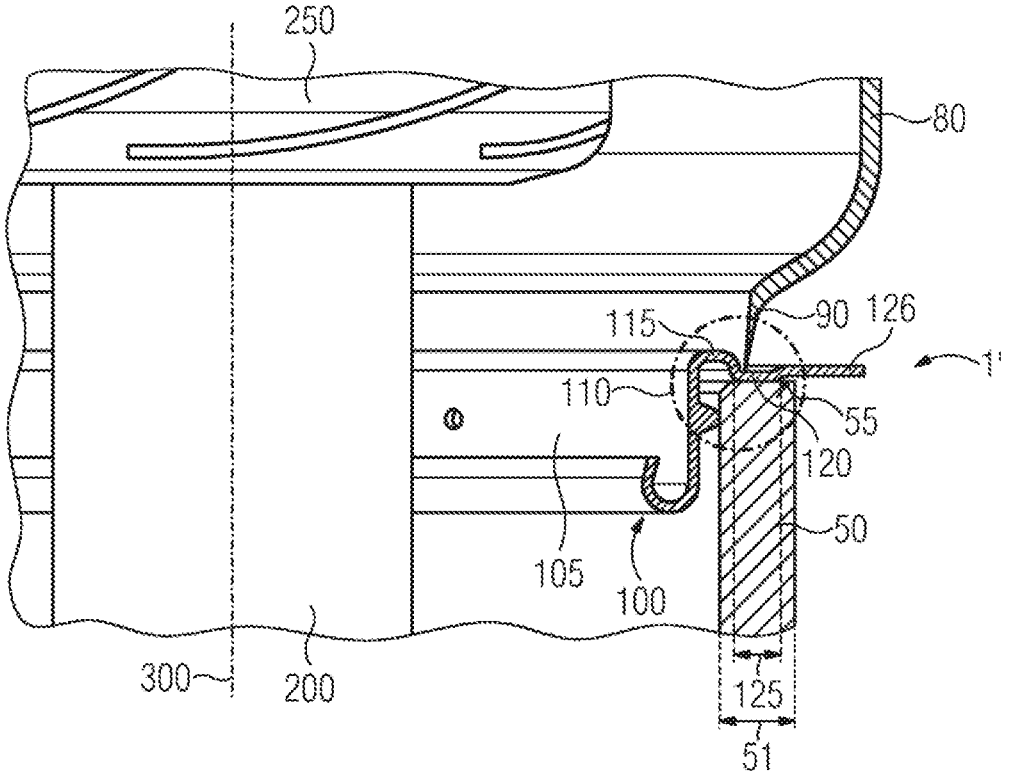
FIG. 2: schematic representation of a portion of a vacuum interrupter having a shield element according to the invention.

FIG. 2 shows a portion of a vacuum interrupter 1' having a shield element 100 according to the invention, a contact rod 200 having a contact body 250, and a central axis 300 of the vacuum interrupter 1' and of the contact rod 200. The vacuum interrupter 1' additionally has an electrically insulating wall element 50, which has an end face 55, and an electrically conductive wall element 80, which has a tapered region 90.

The shield element 100 is of circular shape, and from the centre has a shield inner region 105 that adjoins a connection region 110, the connection region having a first structure 115 and a second structure 120. Adjoining the second structure 120 is a shield outer region 126. An inner, free end of the shield inner region 105 here is rolled inward, and thus forms a field-optimized shield element 100.

In the example shown, the first structure and the second structure have the shape of a U-shaped bend. The first structure 115 and the second structure 120 share a limb. The second structure 120 lies, with a side that is opposite an opening of the second structure, against the end face 55 of the electrically insulating wall element 50, and is soldered there. Since the second structure 125 has a width 125 with which it lies on the end face 55, and which is less than a wall thickness 51 of the electrically insulating wall element 50, the amount of induced mechanical stresses introduced is less. Through the opening of the second structure, the tapered region 90 of the electrically conductive wall element 80 rests on the inner bottom of the second structure 120, and is soldered there. In particular, if the shield element 100, the electrically insulating wall element 50 and the electrically conductive wall element 80 are all made of different materials, the risk of cracks due to induced mechanical stresses is high, in particular in the electrically insulating wall element 50. The first structure 115 and the second structure 120 reduce the introduction of induced mechanical stresses into the electrically insulating wall element 50.

Figure 3:
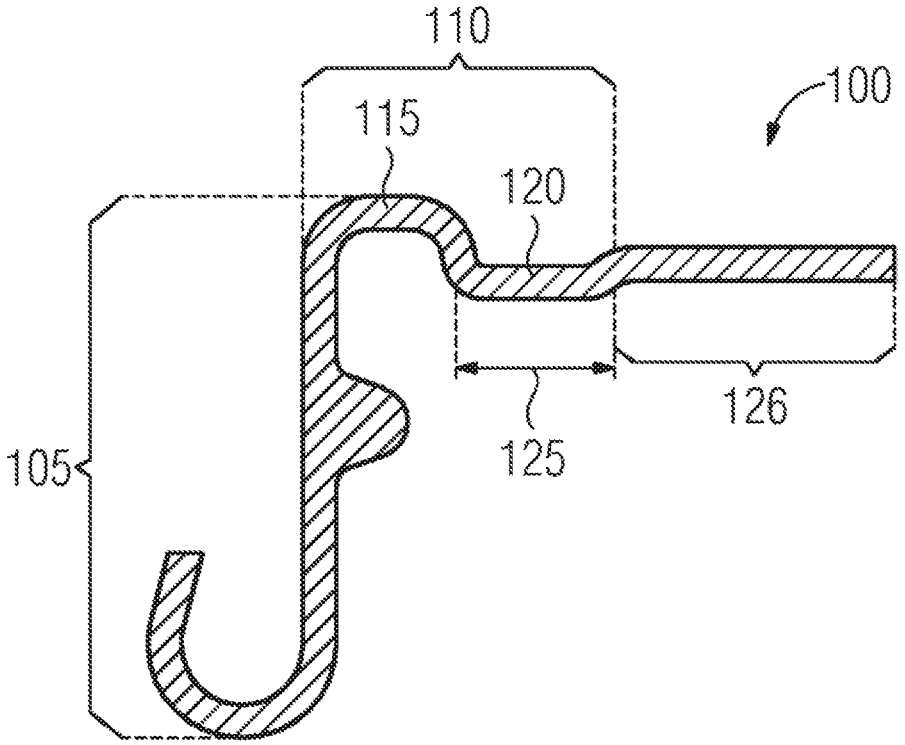
FIG. 3: radial section through a shield element according to the invention.

FIG. 3 shows a radial section from the central axis 300 outward through a shield element 100. From the inside outward, the shield element 100 has a shield inner region 105, the free end of which here is rolled inward. Adjoining the shield inner region 105 is the connection region 110, which has a first structure 115 and a second structure 120. The first structure 115 and the second structure 120 have a common limb. The second structure has a width 125. The second structure is adjoined by the shield outer region 126. The shield outer region 126 is used for field control in the outer region of the vacuum interrupter 1', in particular at high voltages above 70 kV, in particular 72 kV, and particularly preferably above 140 kV, in particular 145 kV.

LIST OF REFERENCES

1 portion of a vacuum interrupter;
1' portion of a vacuum interrupter;
5 electrically insulating wall element of the vacuum interrupter 1;
8 electrically conductive wall element of the vacuum interrupter 1;
9 tapered region of the electrically conductive wall element 8;
10 shield element of the vacuum interrupter 1;
20 switching contact of the vacuum interrupter 1;
25 switching-contact body of the vacuum interrupter 1;
30 central axis of the switching contact 20 and of the vacuum interrupter 1;
50 electrically insulating wall element of the vacuum interrupter 1';
51 wall thickness of the electrically insulating wall element 50 of the vacuum interrupter 1';
55 end face of the electrically insulating wall element 50;
56 inner side of the electrically insulating wall element 50;
58 outer side of the electrically insulating wall element 50;
80 electrically conductive wall element of the vacuum interrupter 1';
90 tapered region of the electrically conductive wall element 80;
100 shield element
105 shield inner region of the shield element 100, which is arranged within the vacuum interrupter 1';

110 connection region here between electrically conductive wall element 80, shield element 100 and electrically insulating wall element 50;

115 first structure, in particular first U-shaped bend in the shield element 100;

120 second structure, in particular second U-shaped bend in the shield element 100;

125 width of the second U-shaped bend in the shield element 100;

126 shield outer region, which projects out of the vacuum interrupter 1';

200 switching contact of the vacuum interrupter 1';

250 switching-contact body of the vacuum interrupter 1';

300 central axis of the switching contact 200 and of the vacuum interrupter 1'

The invention claimed is:

1. A shield element for a vacuum interrupter to be installed between an electrically conductive wall element and an electrically insulating wall element of the vacuum interrupter, the shield element comprising:

a shield inner region configured for installation within the vacuum interrupter;

a shield outer region configured for installation outside of the vacuum interrupter;

a connection region having a U-shaped first structure and a U-shaped second structure preventing an occurrence of mechanical stresses after soldering the vacuum interrupter;

said shield outer region running linearly from an outer end of said shield outer region to said second structure in a radial section of the shield element;

said first structure and said second structure having a common limb and forming an opening of said first structure facing in a direction opposite to a direction of an opening of said second structure; and said first structure having a further limb, different than said common limb of said first structure and said second structure, said further limb extending further and merging into said shield inner region.

2. The shield element according to claim 1, wherein said shield outer region runs linearly from said outer end to said second structure perpendicularly to a central axis of the vacuum interrupter.

3. A vacuum interrupter, comprising at least one shield element according to claim 1.

4. A method for producing a vacuum interrupter, the method comprising the following steps:

applying a solder material for treating joints of vacuum interrupter components including at least:

electrically insulating wall elements having an end face, electrically conductive wall elements, and a shield element according to claim 1;

providing the end face of the electrically insulating wall element with a metallization, and treating the metallization with the solder material;

stacking the components being soldered or to be soldered in a single method step in a vacuum furnace;

placing the shield element between the electrically insulating wall element and the electrically conductive wall element with a tapered region of the electrically conductive wall element disposed in an opening of the second structure and resting on a base of the second structure and with a side of the second structure disposed opposite the opening lying entirely on the solder-treated metallization of the end face; and causing the solder material to flow between the components to be connected during soldering, and preventing or reducing induced mechanical stresses causing components to fracture during cooling.

5. The method according to claim 4, which further comprises:

initially forming a metal sheet into the shield element having the shield inner region, the first structure, the second structure and the shield outer region; and following the forming step, providing the shield element with a shape, in a radial section, in which:

the shield outer region runs linearly from an outer end of the shield outer region to the second structure, the second structure and the first structure are U-shaped, the first structure and the second structure have a common limb forming an opening of the first structure facing in a direction opposite to a direction in which an opening of the second structure faces, and another limb of the first structure, being different than the common limb of the first structure and the second structure, extends further and merges into the shield inner region.

6. The method according to claim 5, wherein the shield outer region runs linearly from the outer end of the shield outer region to the second structure perpendicularly to a central axis of a vacuum interrupter.

7. The method according to claim 4, wherein the components in which mechanical stresses are prevented or reduced are the electrically insulating wall elements.

8. A shield element for a vacuum interrupter to be installed between an electrically conductive wall element and an electrically insulating wall element of the vacuum interrupter, the shield element comprising:

a shield inner region configured for installation within the vacuum interrupter;

a shield outer region configured for installation outside of the vacuum interrupter;

a connection region having a first structure and a second structure preventing an occurrence of mechanical stresses after soldering the vacuum interrupter;

said first structure and said second structure, when fitted in the vacuum interrupter, adjoining one another with said first structure contacting an end face of the electrically insulating wall element with a limb also being a limb of said second structure, without contacting at least one of an inner side of the electrically insulating wall element or an edge between the inner side and the end face; and said second structure contacting the end face of the electrically insulating wall element without contacting at least one of an outer side of the electrically insulating wall element or an edge between the outer side and the end face of the electrically insulating wall element.

9. The shield element according to claim 8, wherein at least one of said first structure or said second structure is configured as a U-shaped bend having an opening or a U-shaped box having an opening.

10. The shield element according to claim 9, wherein said opening of said U-shaped bend or said opening of said U-shaped box face in opposite directions.

11. The shield element according to claim 10, wherein:

said opening of said first structure is oriented parallel to a central axis of the vacuum interrupter and toward the end face of the electrically insulating wall element; and said opening of said second structure is oriented parallel to the central axis of the vacuum interrupter and away from the end face of the electrically insulating wall element.

12. The shield element according to claim 11, wherein said U-shaped bend or said U-shaped box of said second structure has a width being less than a wall thickness of the electrically insulating wall element.

* * * * *